US009222321B2

(12) United States Patent
Nellessen, Jr. et al.

(10) Patent No.: US 9,222,321 B2
(45) Date of Patent: Dec. 29, 2015

(54) ORIENTING A SUBSEA TUBING HANGER ASSEMBLY

(75) Inventors: Peter Nellessen, Jr., Palm Beach Gardens, FL (US); Matthew Niemeyer, League City, TX (US); Laure Mandrou, Bellaire, TX (US); Baptiste Germond, Drucat (FR); John Yarnold, League City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 307 days.

(21) Appl. No.: 13/594,687

(22) Filed: Aug. 24, 2012

(65) Prior Publication Data

US 2014/0054044 A1 Feb. 27, 2014

(51) Int. Cl.
*E21B 33/12* (2006.01)
*E21B 33/043* (2006.01)
*E21B 23/01* (2006.01)

(52) U.S. Cl.
CPC ..... *E21B 23/01* (2013.01); *E21B 33/043* (2013.01)

(58) Field of Classification Search
None
See application file for complete search history.

(56) References Cited

U.S. PATENT DOCUMENTS

| | | | | |
|---|---|---|---|---|
| 3,661,206 | A * | 5/1972 | Putch et al. | 166/89.2 |
| 4,386,656 | A * | 6/1983 | Fisher et al. | 166/117.5 |
| 4,712,620 | A * | 12/1987 | Lim et al. | 166/355 |
| 5,857,524 | A * | 1/1999 | Harris et al. | 166/382 |
| 6,470,968 | B1 | 10/2002 | Turner | |
| 6,725,924 | B2 | 4/2004 | Davidson et al. | |
| 7,395,866 | B2 | 7/2008 | Milberger et al. | |
| 8,381,819 | B2 * | 2/2013 | Fern et al. | 166/345 |
| 2002/0189806 | A1 * | 12/2002 | Davidson et al. | 166/250.01 |
| 2005/0121198 | A1 | 6/2005 | Andrews | |
| 2006/0108118 | A1 | 5/2006 | Bartlett | |
| 2007/0039738 | A1 | 2/2007 | Fenton et al. | |
| 2009/0314496 | A1 * | 12/2009 | Begnaud et al. | 166/380 |
| 2013/0056282 | A1 * | 3/2013 | Robottom | 175/320 |

* cited by examiner

*Primary Examiner* — Matthew Buck
*Assistant Examiner* — Douglas S Wood
(74) *Attorney, Agent, or Firm* — Patrick Traister

(57) ABSTRACT

An apparatus includes an engagement device to be disposed on a landing string. The engagement device includes a retracted state to allow the apparatus to be run inside a riser and an expanded state to engage the riser to secure the apparatus to the riser. The apparatus further includes an actuator assembly to be disposed on the landing string. The actuator assembly is remotely actuatable from a sea surface to rotate a tubing of the landing string relative to the engagement device to rotate the landing string to orient a tubing hanger assembly.

20 Claims, 7 Drawing Sheets

ORIENTING A SUBSEA TUBING HANGER ASSEMBLY

BACKGROUND

A production tubing string may be used in a subsea well for purposes of communicating produced well fluid from the well. The production tubing string may be suspended, or hang, from a wellhead of the subsea well. In this manner, the top end of the production tubing may include a tubing hanger assembly, which rests on a landing profile in the wellhead, and the remainder of the production tubing string hangs from the assembly.

For purposes of completing the subsea well, the production tubing string may be run into the well on the end of a landing string. In this manner, at its lower end, the landing string has a tubing hanger running tool that is initially secured to the tubing hanger assembly and is remotely controlled to release the tubing hanger assembly from the landing string after the assembly has landed inside the wellhead. The landing and production tubing strings may be run from a surface platform (a surface vessel, for example) down to the subsea equipment (a well tree, a blowout preventer (BOP), and so forth) inside a marine riser, which extends between the subsea equipment and the surface platform. The marine riser protects the landing string, production tubing string and other equipment that are installed in the subsea well from the sea environment.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an exemplary implementation, a technique includes deploying a landing string inside a riser beneath a sea surface to land a tubing hanger assembly in a wellhead of a subsea well. A rotator assembly deployed beneath the sea surface is used to rotate the landing string to orient the tubing hanger assembly relative to the wellhead.

In another exemplary implementation, a system that is usable with a well includes a landing string, and a tubing hanger assembly and a rotator assembly are disposed on the landing string. The rotator assembly rotates the landing string beneath a sea surface to orient the tubing hanger assembly relative to a landing profile of a wellhead.

In yet another exemplary implementation, an apparatus includes an engagement device to be disposed on a landing string. The engagement device includes a retracted state to allow the apparatus to be run inside a riser and an expanded state to engage the riser to secure the apparatus to the riser. The apparatus further includes an actuator assembly to be disposed on the landing string. The actuator assembly is remotely actuatable from a sea surface to rotate a tubing of the landing string relative to the engagement device to rotate the landing string to orient a tubing hanger assembly.

Advantages and other features will become apparent from the following drawing, description and claims.

DETAILED DESCRIPTION

Figure 1:
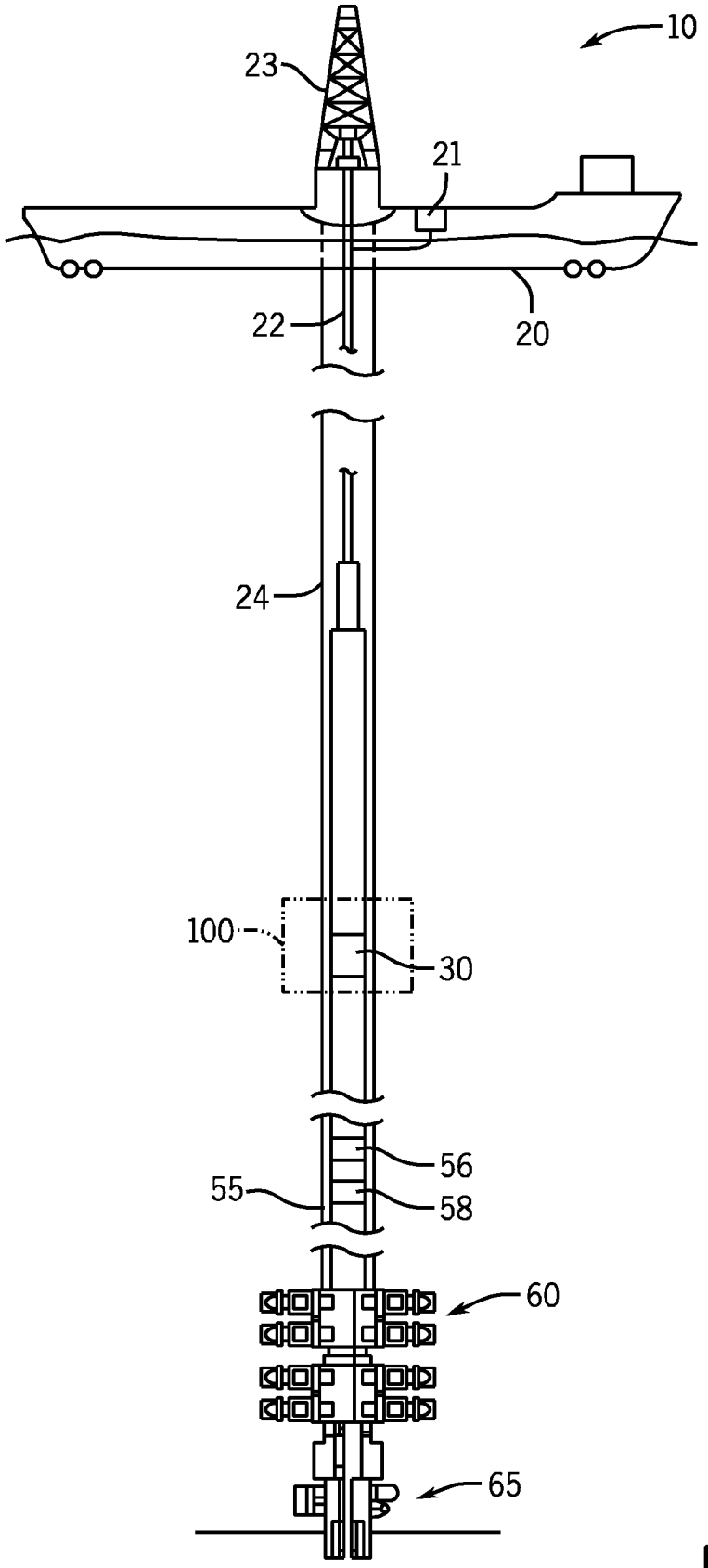
FIG. 1 is a schematic diagram of a subsea well system according to an exemplary implementation.

In the following description, numerous details are set forth to provide an understanding of features of various embodiments. However, it will be understood by those skilled in the art that the subject matter that is set forth in the claims may be practiced without these details and that numerous variations or modifications from the described embodiments are possible.

As used herein, terms, such as "up" and "down"; "upper" and "lower"; "upwardly" and "downwardly"; "upstream" and "downstream"; "above" and "below"; and other like terms indicating relative positions above or below a given point or element are used in this description to more clearly describe some embodiments. However, when applied to equipment and methods for use in environments that are deviated or horizontal, such terms may refer to a left to right, right to left, or other relationship as appropriate.

In general, systems and techniques are disclosed herein for purposes of installing completion equipment (a production tubing string, valves and so forth) in a subsea well. More specifically, in accordance with techniques that are disclosed herein, the completion equipment is installed using a landing string; and the landing string and completion equipment are run inside a marine riser that extends from a sea surface platform to the equipment on the sea floor.

The completion equipment includes a production tubing string, which contains a tubing hanger assembly at its upper end. Upon completion of its installation, the tubing hanger assembly rests in the subsea well's wellhead so that the remainder of the production tubing string is suspended from the assembly. The tubing hanger assembly contains electrical connectors and ports (control fluid, chemical injection and production fluid ports, as examples) that are constructed to align with corresponding ports of the wellhead. Therefore, the landing of the tubing hanger assembly in the wellhead may involve rotating the landing string so that the tubing hanger assembly has the appropriate rotational, or azimuthal, orientation for proper port alignment.

One way to manipulate the azimuthal orientation of the tubing hanger assembly is to rotate the landing string from the surface platform using the surface platform's top drive or rotary table. For example, the landing string may be rotated using the top drive or rotary table until a tubing hanger orientation joint of the landing string engages a pin of the blowout preventer (BOP) for purposes of guiding the tubing hanger assembly to the appropriate azimuthal orientation. Such factors as the weight offset of the landing string and the length of the deployed string may be monitored at the surface platform for purposes of determining when this engagement has occurred and/or for purposes of determining when the tubing hanger assembly has landed. Significant delays may be incurred rotationally positioning the tubing hanger assembly using this approach due to the length of the landing string. In this manner, a significant delay may be incurred between the time that a given rotational change is applied at the surface platform (at the top end of the landing string) and the time that the tubing hanger assembly (disposed at the bottom end of the landing string) rotates in response thereto.

In accordance with exemplary implementations that are disclosed herein, a landing string includes a rotator assembly, which is constructed to form a subsea rotation point for the landing string, which is closer to the subsea well. In this manner, as disclosed herein, the rotator assembly is constructed to, beneath the sea surface, engage the marine riser and exert a torque to rotate the landing string for purposes of rotationally orienting the tubing hanger assembly during the tubing hanger assembly's installation. Because the point of the landing string at which the torque is applied is relatively closer to the subsea well (as compared to the surface platform), the installation time of well completion equipment may be reduced.

As a more specific example, referring to FIG. 1, a subsea well system 10 includes a sea surface platform 20 (a surface vessel as depicted in FIG. 1 or a fixed platform, as examples), which includes a rig 23 and other associated equipment for purposes of deploying and managing the deployment of completion equipment into a subsea well. In general, the surface platform 20 may include control and monitoring circuitry 21 for purposes of monitoring and controlling the deployment of the subsea equipment.

In accordance with exemplary implementations, the subsea well system 10 includes a marine riser 24, which extends downwardly from the surface platform 20 to sea floor equipment that defines the entry point of the subsea well. In this regard, the lower, subsea end of the marine riser 24 connects to a subsea well tree 60 (a vertical well tree, for example) that contains such components as valves and a blowout preventer (BOP). The subsea well tree 60, in turn, is connected to a well head 65 of the subsea well.

The marine riser 24 provides protection from the surrounding sea environment for strings that are run through the riser 24 from the surface platform 20 and into the subsea well. In this manner, a landing string 22 may be run inside the marine riser 24 from the sea surface platform 20 to the subsea well for purposes of installing completion equipment, such as a production tubing string 55, in the subsea well, well cleaning, well testing, etc.

At its upper end, the production tubing string 55 includes a tubing hanger assembly 58 from which the remaining part of the production tubing string 55 hangs after the tubing hanger assembly 58 lands in a landing profile of the wellhead 65. For purposes of running the production tubing string 55, the tubing hanger assembly 58 is releasably secured to the bottom end of the landing string 22 by a tubing hanger running tool 56. The tubing hanger assembly 58 has an associated azimuthal orientation that aligns with a corresponding azimuthal orientation of ports of the wellhead when the assembly 58 is properly landed in the wellhead 65. In this orientation, electrical connectors and ports (chemical injection, control line and production fluid ports, as examples) of the tubing hanger assembly 58 align with corresponding connectors and ports of the wellhead 65, and the tubing hanger assembly rests in a landing profile of the wellhead 65, in accordance with exemplary implementations.

It is noted that FIG. 1 is a simplified view of the subsea well system 10 for purposes of discussing certain aspects of the system 10 and the installation of equipment in a subsea well. For example, the landing string 22 and production tubing string 55 may have many other components than the components described herein, as can be appreciated by the skilled artisan.

For purposes of rotating the tubing hanger assembly 58 during its deployment, the landing string 22 includes a rotator assembly 30, which is constructed to be remotely actuated from the sea surface (using control equipment disposed on the surface platform 20, for example) to 1. engage the marine riser 24 beneath the sea surface and 2. apply a torque to cause rotation of the landing string 22. By rotating the landing string 22 at such a sub-sea surface rotation point, the tubing hanger assembly 58 may be more rapidly and accurately landed (as compared to rotating the landing string 22 using a surface platform-based mechanism, for example), in accordance with example implementations.

Figure 2:
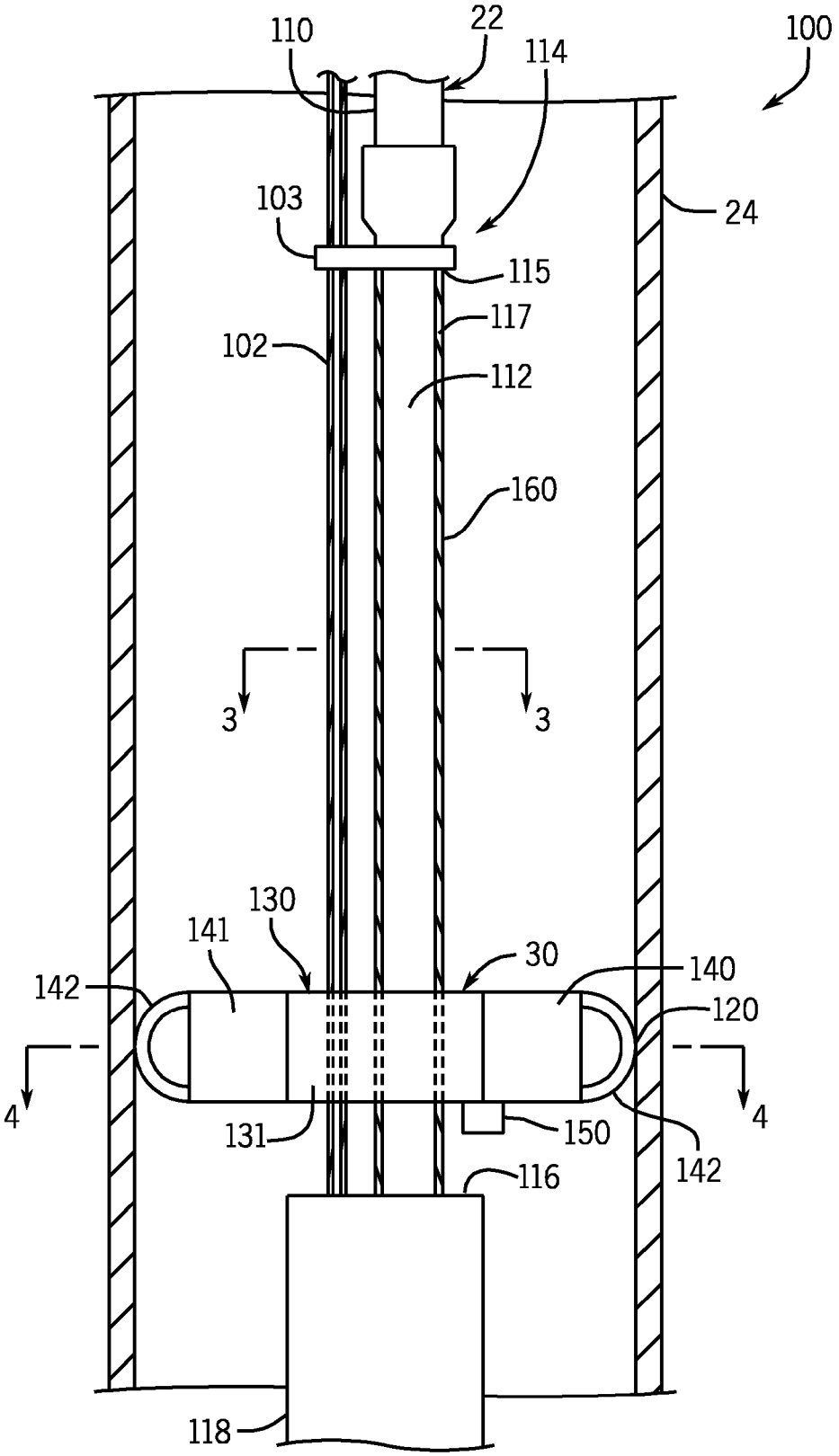
FIG. 2 is a cross-sectional schematic view of a section of the system of FIG. 1 according to an exemplary implementation.

As a more specific example, FIG. 2 depicts an exemplary section 100 of the landing string 22 in accordance with an exemplary implementation. Referring to FIG. 2 in conjunction with FIG. 1, for this example, the rotator assembly 30 has two states: a first, retracted state (not depicted in FIG. 2), in which the rotator assembly 30 has a reduced outer diameter for purposes of allowing the rotator assembly 30 (and landing string 22) to pass freely through the marine riser 24; and a second, radially expanded state (depicted in FIG. 2), in which the rotator assembly 30 engages the inner surface of the marine riser 24 for purposes of rotationally securing the rotator assembly 30 to the riser 24 to form a corresponding subsea rotation location 120. In accordance with exemplary implementations, although rotationally secured to the marine riser 24, the landing string 22 may be longitudinally translated along the riser 24 (i.e., the rotation location 120 may be longitudinally translated) for purposes of advancing the tubing hanger assembly 58 toward the subsea well.

More specifically, in accordance with an exemplary implementation, the rotator assembly 30, circumscribes a profiled tubular section 117 of the remainder of the landing string 22; and the profiled tubular section 117 has an outer surface 160 that, as described below, is constructed to be engaged by the rotator assembly 30 to allow the assembly 30 to turn the section 117 (and thus, rotate the remainder of the landing string 22). The section 117 forms a longitudinal slip segment (between an upper end 115 and lower end 116 of the section 117) along which relative longitudinal translation may occur between the rotator assembly 30 and the landing string 22. In this manner, when the rotator assembly 30 is expanded in its radially expanded state and is secured to the marine riser 24 (as depicted in FIG. 2), the landing string 22 may be picked up and set down (as appropriate) for the longitudinal range of travel defined by the section 117.

In general, the section 117 is a tubular section that is connected to tubular sections 110 and 118 of the landing string 22 at the section's upper 115 and lower 116 ends, respectively. A central passageway 112 of the section 117 forms a corresponding central passageway segment of the landing string 22.

As also depicted in FIG. 2, an umbilical 102 may be attached (using connectors or straps, such as exemplary connector 103) to the landing string 22 and extend through a rotationally stationary portion of the rotator assembly 30. Although the umbilical 102 is depicted in FIG. 2 as containing a single fluid communication line, the umbilical may contain multiple lines, depending on the particular implementation. Moreover, the umbilical 102 may contain one or more electrical lines, fluid lines, fiber optic lines, and so forth, depending on the particular implementation; and such line(s)

may be used for such purposes of communicating control signals, communicating telemetry data, providing power and so forth, as can be appreciated by the skilled artisan.

In accordance with exemplary implementations, one or more of these lines of the umbilical 102 may be used to communicate power to the rotator assembly 30; provide signals to control when the rotator assembly 30 applies torque to the section 117; provide signals to control when the rotator assembly 30 radially expands to engage the marine riser 24; provide power to rotate the landing string 22; provide power to engage the marine riser 24; and so forth. For example, in accordance with some implementations, one of the umbilical lines may be used to deliver electrical power or deliver hydraulic power (from a sea floor-disposed power unit or a sea surface power unit, for example) to actuate the rotator assembly 30. The central passageway of the landing string 22 and/or the string's annulus may alternatively be used for any of these purposes, in accordance with further implementations, for such purposes.

For purposes of generating the torque to rotate the landing string 22, the rotator assembly 30 includes an actuator 150, which may include, for example, a motor (an electrical or hydraulic motor, as examples) and a gear box (coupled to the drive shaft of the motor) to apply torque to the section 117 when power is received by the motor. In some implementations, the rotator assembly 30 may include a control interface that receives control signals (communicated from the surface platform 20, for example) to regulate operation of the rotator assembly 30. As examples, the control signals may indicate a desired degree of angular rotation, or on/off control of the rotation. In other implementations, power to the rotator assembly 30 may be regulated (at the surface platform 20, for example) to control when the rotator assembly 30 applies torque to the section 117. Thus, many variations are contemplated, which are within the scope of the appended claims.

The actuator 150 is secured to an outer assembly 140 of the rotator assembly 30; and the actuator 150 is constructed to rotate an inner assembly 130 of the rotator assembly 30, which engages the section 117. The outer assembly 140, in turn, is constructed to engage the inner surface of the marine riser 24.

As an example, in accordance with some implementations, the outer assembly 140 includes a bladder 142 that is constructed to receive a fluid (delivered via a line of the umbilical 102, for example) for purposes of inflating the bladder 142 to cause the bladder 142 to radially expand to contact the inner surface of the marine riser 24 to secure the rotator assembly 30 to the riser 24. The outer assembly 140 may have other engagement devices (a slip, a swellable material, a packer, a resilient element, an elastomer, an expandable spring, and so forth) to releasably secure the rotator assembly 30 to the marine riser 24, in accordance with other implementations.

Figure 3:
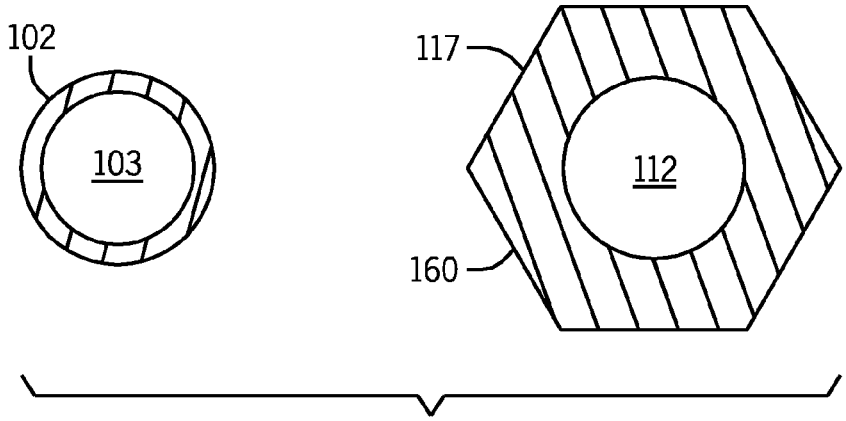
FIG. 3 is a cross-sectional view taken along line 3-3 of FIG. 2 according to an exemplary implementation.

Referring to FIG. 3 in conjunction with FIG. 2, in accordance with exemplary implementations, the section 117 may have a hexagonal cross-section to form a corresponding hexagonal-shape outer profile 160 to facilitate engagement with the rotator assembly 30. More specifically, referring to FIG. 4 in conjunction with FIG. 2, in accordance with an exemplary implementation, the inner assembly 130 has a body 131 that has a centrally disposed, complimentary hexagonally-shaped opening 170 for purposes of engaging the outer profile 160 of the section 117.

Figure 4:
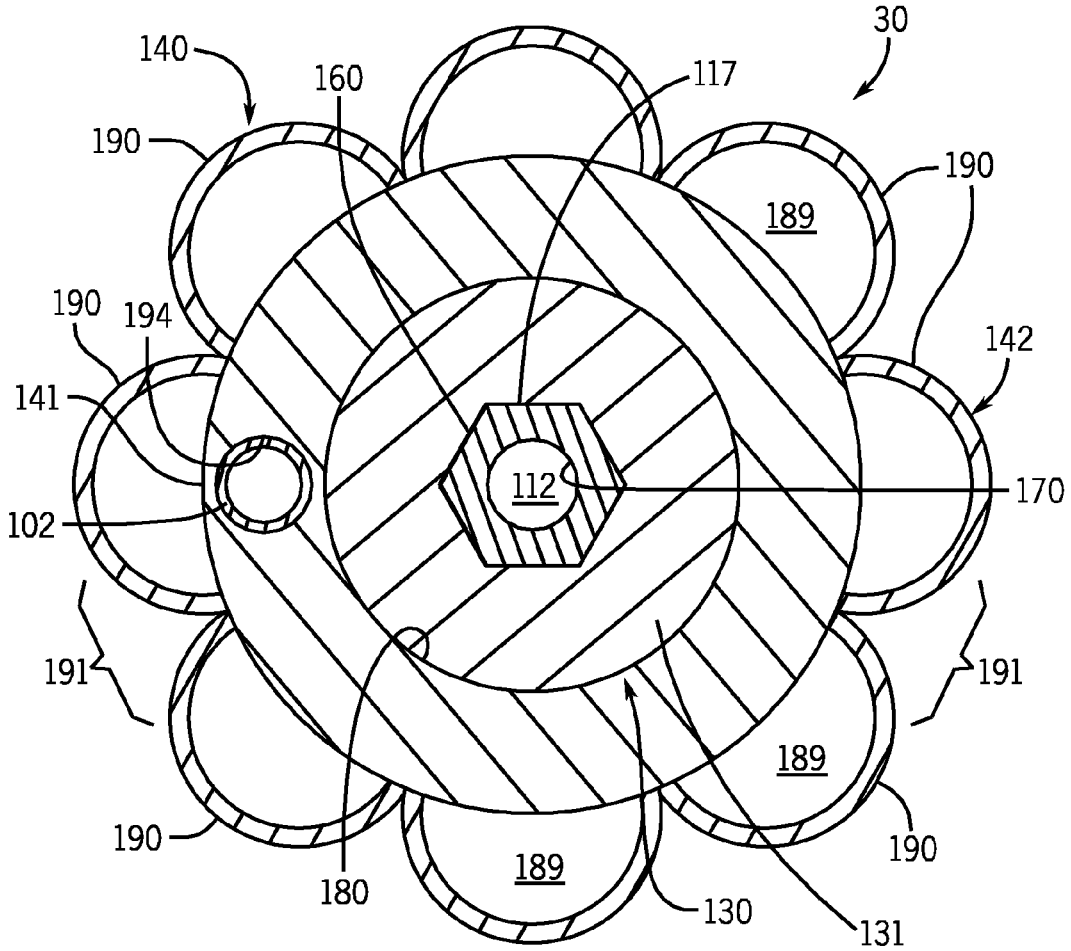
FIG. 4 is a cross-sectional view taken along line 4-4 of FIG. 2 according to an exemplary implementation.

The body 131 may have a generally circularly cylindrical outer profile that circumscribes the opening 170. Moreover, the outer assembly 140, in accordance with example implementations, includes a body 141 that has an inner circular profile 180 that corresponds to the outer circular profile of the inner assembly body 131 so that the inner assembly 130 may rotate with respect to the outer assembly 140. As depicted in FIG. 4, in accordance with example implementations, the outer assembly 140, which is stationary when the inner assembly 130 rotates, may include at least one opening 194 for purposes of receiving the umbilical 102.

As depicted in FIG. 4, in accordance with example implementations, the inflatable bladder 142 may be ribbed or pleated to form longitudinally extending sections 190, which may be inflated (via fluid delivered through a control line, such as control line 102, for example) for purposes of radially expanding the bladder 142 to engage the marine riser 24. In this manner, the bladder 142 may be formed from an expandable material (an elastomer, for example); and each section 190 may extend along the longitudinal axis of the string 22 and have an interior region 189 that receives a fluid to cause the expandable material to radially expand. As depicted in FIG. 4, the sections 190 do not form a complete annular seal about the body 141 for purposes of forming annular gaps 191 to permit fluid to be communicated between the landing string 22 and the marine riser 24 while the rotator assembly 30 is in its radially expanded state.

Referring to FIG. 4 in conjunction with FIG. 2, as noted above, the actuator 150 may take on numerous forms, depending on the particular implementation. Depending on the particular implementation, the actuator 150 may be physically disposed below (as depicted in FIG. 2) or above the inner 130 and outer 140 assemblies. In further implementations, the actuator 150 may be incorporated into the inner 130 and outer 140 assemblies. For example, in accordance with further implementations, the inner assembly body 131 may include windings to form an inductive cage, which rotates the inner assembly 130 due to an energized outer winding that circumscribes the inner cage and is disposed inside the outer assembly body 141. Thus, many variations are contemplated, which are within the scope of the appended claims.

Figure 5:
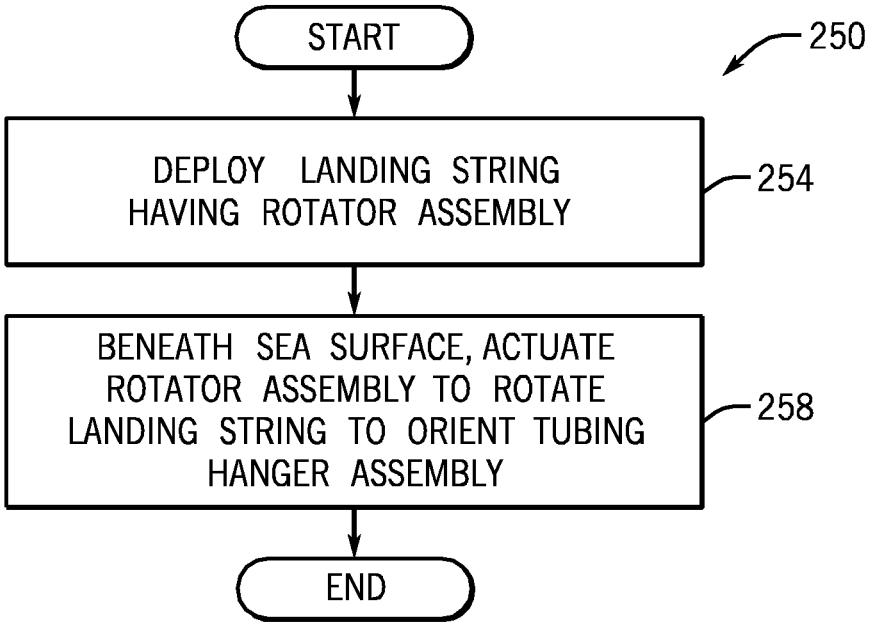
FIGS. 5, 6 and 9 are flow diagrams depicting techniques to orient and land a tubing hanger assembly in a subsea well according to exemplary implementations.

Regardless of the specific implementation of the rotator assembly, a technique 250 (see FIG. 5) generally includes deploying (block 254) a landing string having a rotator assembly; and beneath the sea surface, using the actuator to rotate the landing string to orient a tubing hanger assembly, pursuant to block 258.

Figure 6:
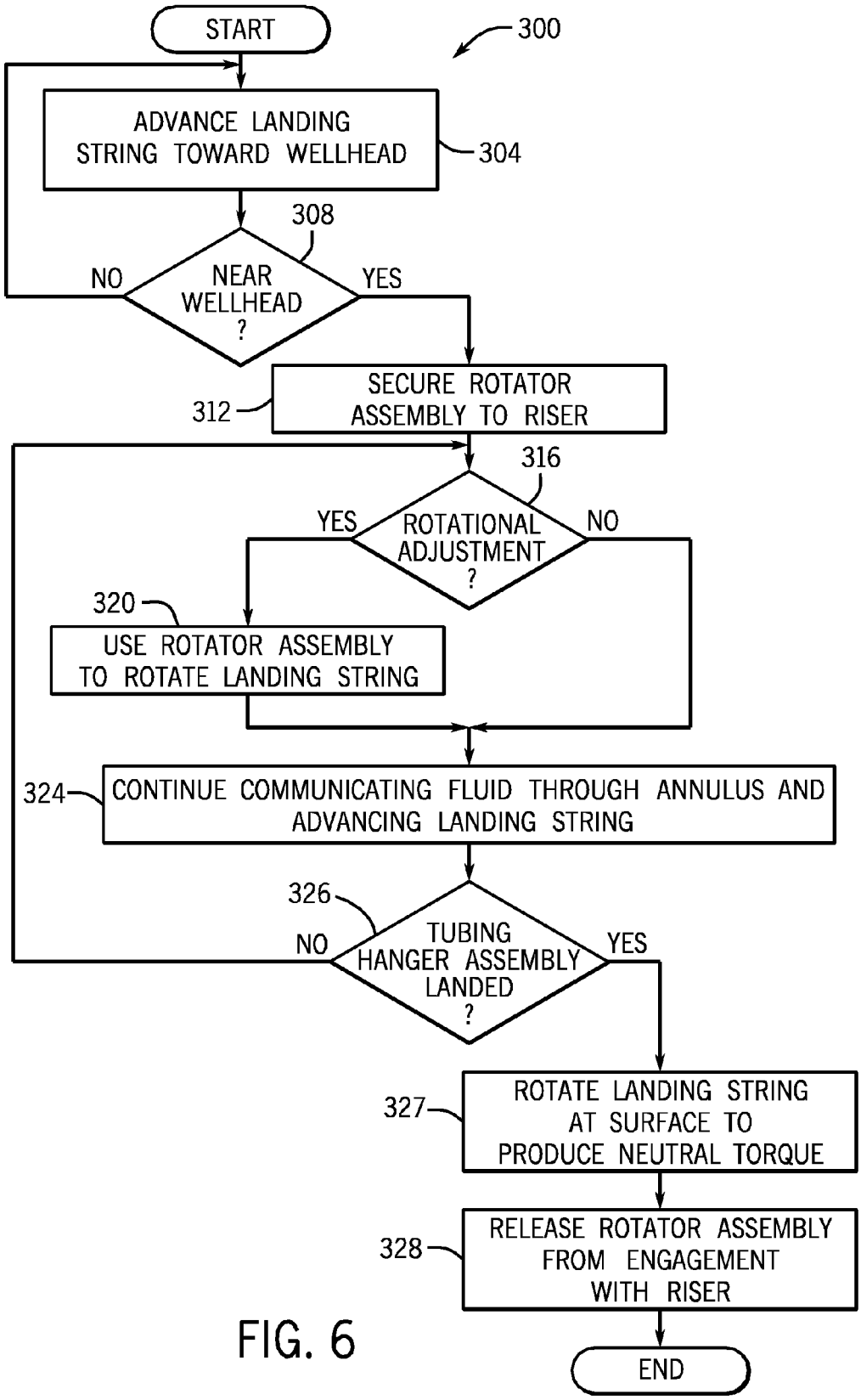

More specifically, FIG. 6 depicts an exemplary technique 300, which may be used to orient and land a tubing hanger assembly in a subsea well. Pursuant to the technique 300, a landing string with a rotator assembly is advanced (block 304) toward a subsea wellhead. This advancement occurs until a determination is made (decision block 308) that the tubing hanger assembly is near the wellhead (just above the riser flex joint, for example). Upon this occurrence, the rotator assembly may be remotely controlled to secure (block 312) the rotator assembly to a marine riser, and then the landing string may be advanced and rotated until landed.

In this manner, if a determination is made (decision block 316) to rotationally adjust (i.e., azimuthally adjust) the landing string, then the rotator assembly is actuated (block 320) to rotate the landing string to make an adjustment. Longitudinal advancement of the landing string and communication of fluid through the annular may continue (block 324) as the rotational adjustments are made. After a determination is made (decision block 326) that the tubing hanger assembly has landed, the landing string may be rotated, pursuant to block 327, from the sea surface (using a top driver or rotary table, for example) to produce a neutral torque on the string. Subsequently, pursuant to block 328, the rotator assembly is released from its engagement with the marine riser.

One of many different techniques may be employed for purposes of acquiring information regarding the location of the tubing hanger relative to the well head. For example, in accordance with some implementations, the landing string 22 and/or the marine riser 24 may include sensors and one or more telemetry interfaces to communicate acquired sensor data uphole to the surface platform 20 for purposes of monitoring the position of the tubing hanger assembly. In this regard, such sensors as acoustic sensors, optical sensors, image sensors (cameras, for example), and so forth may be employed. Examples of monitoring systems and techniques that may be used are disclosed in, for example, U.S. Pat. No. 6,725,924, entitled, "System and Technique For Monitoring And Managing The Deployment of Subsea Equipment," which issued on Apr. 27, 2004, and is owned by the same assignee as the present application.

Figure 7:
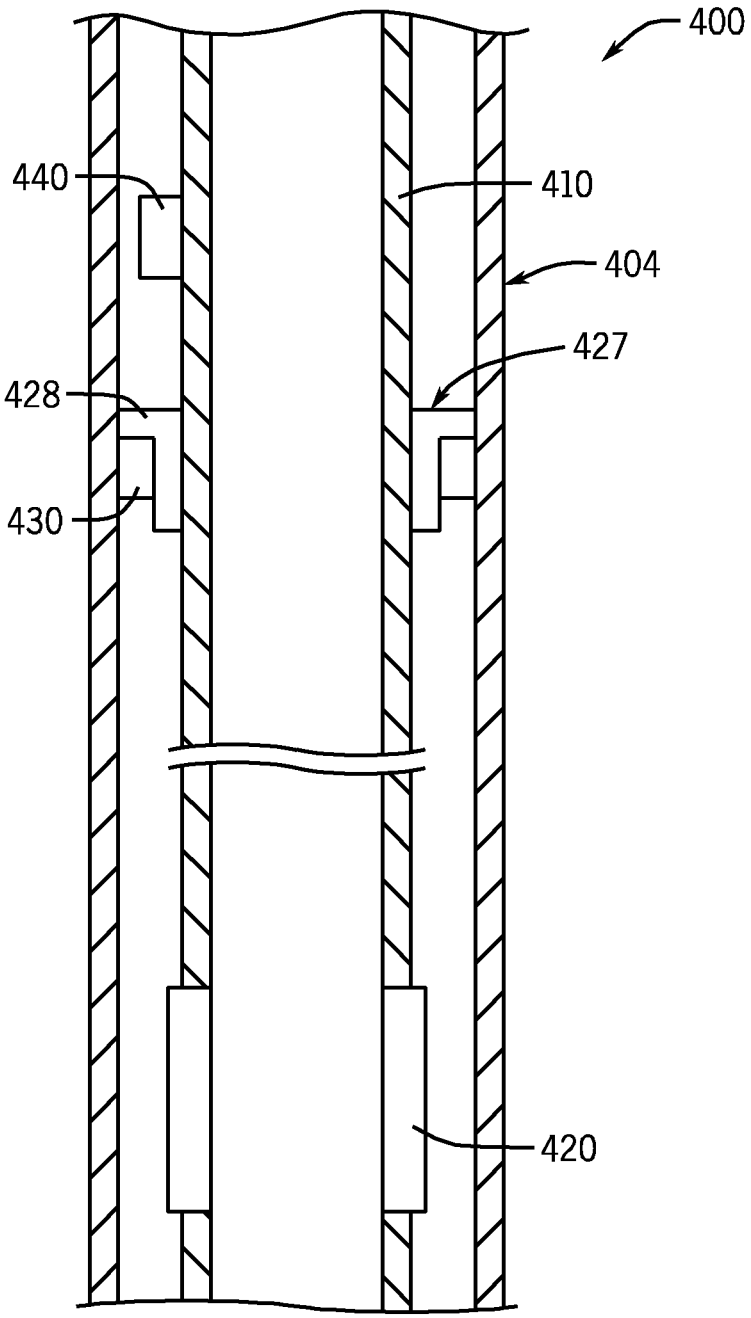
FIG. 7 is a cross-sectional schematic view illustrating a subsea well system according to a further exemplary implementation.

Other variations are contemplated, which are within the scope of the appended claims. For example, in accordance with further implementations, the rotator assembly 30 may be replaced by a rotator assembly 427 (of a well system 400), which is depicted in FIG. 7. The rotator assembly 427 includes an expandable and retractable anchoring mechanism 428 for purposes of engaging a marine riser 404 through which a corresponding landing string 410 (containing the rotator assembly 400) is run. An inner assembly 430 of the rotator assembly 427, which is attached to the landing string 410 rotates with respect to the outer assembly 428 for purposes of rotating the landing string 410 at a subsea rotation point for purposes of orienting a tubing hanger assembly 420 of the landing string 410. Unlike the rotator assembly 30, however, the outer assembly 428 of the rotator assembly 427 is retracted before the string is raised or lowered, in accordance with exemplary implementations. Thus, when a measurement device 440 (a gyroscope, for example) communicates (via a telemetry interface that communicates data acquired by the gyroscope or pole, for example) that the tubing hanger assembly 420 is in the appropriate rotational orientation, the rotator assembly 427 may be remotely controlled from the sea surface for purposes of radially retracting the outer assembly 428 to allow further advancement of the landing string 410.

Figure 9:
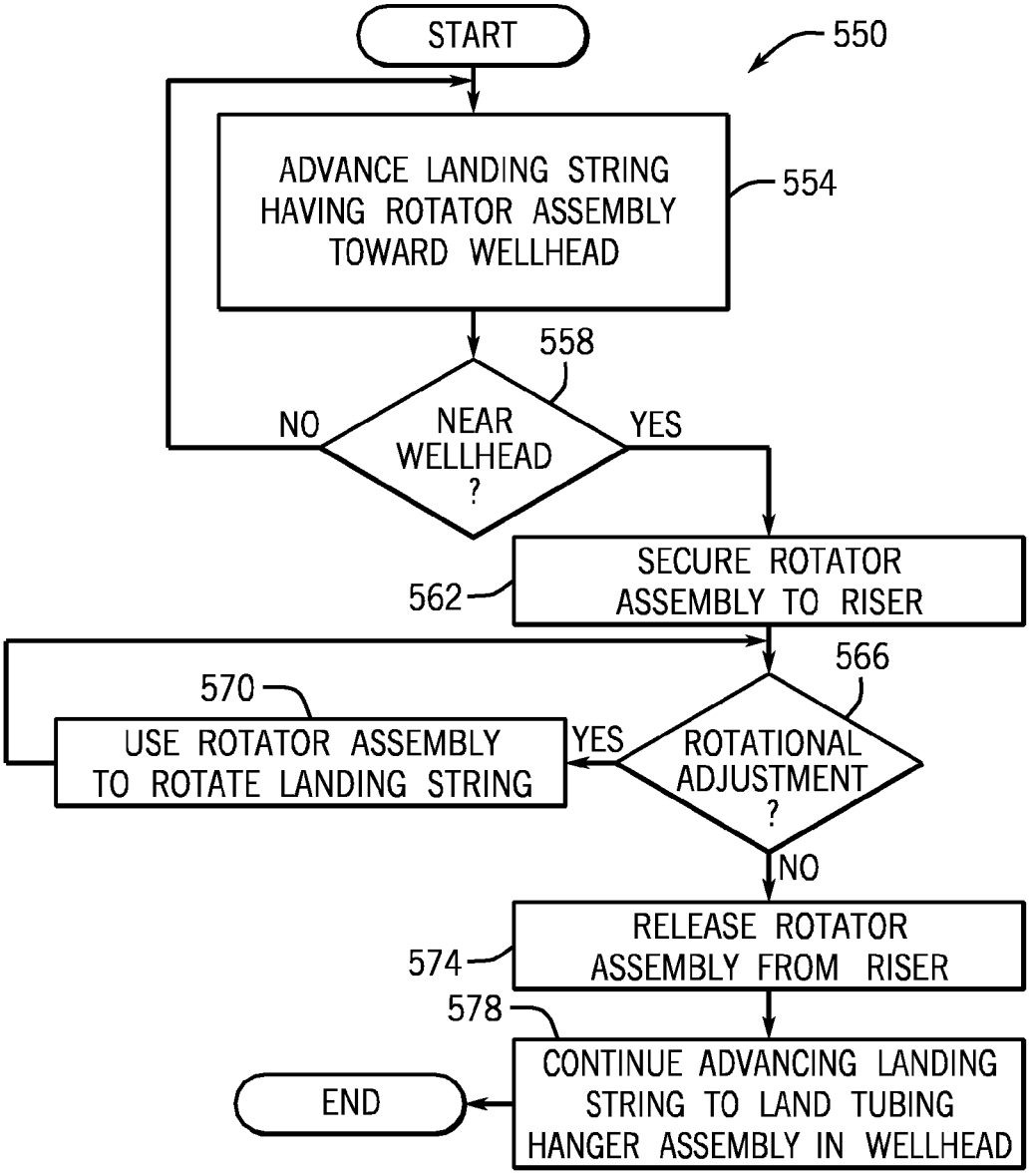

Thus, referring to FIG. 9, a technique 550 in accordance with example implementations includes advancing (block 554) a landing string with a rotator assembly toward a wellhead and continue the advancement until a determination is made (decision block 558) that a tubing hanger assembly is near the wellhead. At this point, the rotator assembly is remotely actuated to secure (block 562) the assembly to the marine riser. Pursuant to decision block 566 and block 570, the rotator assembly is actuated to rotationally adjust the orientation of the tubing hanger until the tubing hanger assembly is aligned for entry into the well tree. At this point, pursuant to the technique 550, the rotator assembly is released (block 574) from the marine riser and advancement of the landing string continues (block 578) to land the tubing hanger in the wellhead.

It is noted that in accordance with further implementations, the rotator assembly 30 may also be retracted after the tubing hanger assembly is aligned and before the landing string 22 is further advanced.

Figure 8:
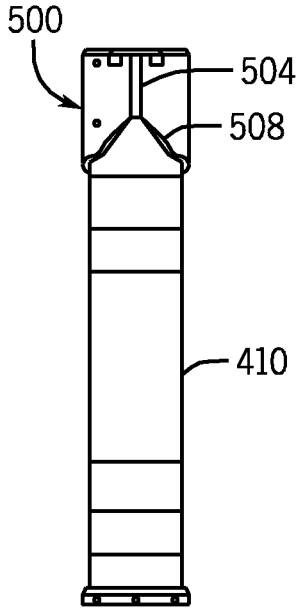
FIG. 8 is a perspective view of a portion of a landing string illustrating a tubing hanger orientation joint according to an exemplary implementation.

As another variation, in accordance with further implementations, the landing string 22, 410 may include a tubing hanger orientation joint 500 (see FIG. 8) for purposes of further facilitating orientation of the tubing hanger assembly. In general, the tubing hanger joint 500 includes a cam profile 508 for engaging a retractable pin of the BOP. In this regard, the cam profile 508, when encountering the BOP pin, causes rotation of the landing string 410 until the pin reaches the apex of the profile 508, which is the entry point of a longitudinal channel 504 of the joint 500. Thus, when the joint 500 engages the BOP pin, the landing string rotates to orientate the channel 504 with respect to the BOP pin.

In further implementations, the well system may not use an umbilical to furnish the controls and power to the rotator assembly 30, 427. In this manner, in these implementations, the controls and power to the rotator assembly 30, 427 may be supplied from landing string controls, which are located subsea on the landing string 22, 410. As an example of another variation, the outer profile 160 of the rotator assembly 30 may not be hexagonal. Moreover, in some implementation, the outer profile may be circular, and the outer assembly may be constructed to frictionally engage the circular profile for purposes of rotating the landing string 22.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method comprising:

deploying a landing string inside a riser beneath a sea surface to land a tubing hanger assembly in a wellhead of a subsea well, the landing string comprising a rotator assembly connected to the landing string above the tubing hanger assembly;

rotationally securing a first portion of the rotator assembly to an inner surface of the riser; and orienting the tubing hanger assembly relative to the wellhead by rotating a second portion of the rotator assembly, the landing string, and the tubing hanger assembly relative to the first portion of the rotator assembly, the riser, and the wellhead by using the rotator assembly while the first portion of the rotator assembly is rotationally secured to the riser.

2. The method of claim 1, further comprising longitudinally advancing the tubing hanger assembly toward the wellhead while the rotator assembly is secured to the riser.

3. The method of claim 2, further comprising:

releasing the rotator assembly from the riser; and landing the oriented tubing hanger in the wellhead.

4. The method of claim 3, further comprising rotating the landing string from a location above the sea surface to produce a substantially neutral torque on the landing string after the tubing hanger assembly is landed in the wellhead.

5. The method of claim 1, further comprising:

releasing the rotator assembly from the riser; and longitudinally advancing the oriented tubing hanger toward the wellhead while the rotator assembly is no longer secured to the riser.

6. The method of claim 1, further comprising longitudinally advancing the oriented tubing hanger assembly toward the wellhead to land the tubing hanger in the wellhead.

7. The method of claim 6, further comprising using a profile disposed on the landing string to rotationally adjust the landing string.

8. The method of claim 1, wherein the rotator assembly comprises an actuator to rotate the landing string relative to the riser.

9. A system usable with a well, comprising:

a landing string;

a tubing hanger assembly disposed on the landing string; and a rotator assembly disposed on the landing string at a position above the tubing hanger assembly, the rotator assembly operable to engage an inner surface of a riser and to rotate a first portion of the rotator assembly, the landing string, and the tubing hanger assembly relative to a second portion of the rotator assembly when the second portion of the rotator assembly is engaged to the riser at a position beneath a sea surface to orient the tubing hanger assembly relative to a landing profile of a subsea wellhead.

10. The system of claim 9, wherein the rotator assembly comprises:

an engagement device having a retracted state to allow the rotator assembly to be run longitudinally inside of the riser and an expanded state to engage the inner surface of the riser to rotationally secure the rotator assembly to the riser; and an actuator remotely actuatable from the sea surface to rotate the landing string relative to the engagement device engaged to the riser.

11. The system of claim 10, wherein the engagement device comprises at least one of a slip, a swellable material, a packer, a resilient element, an elastomer, an expandable spring and a bladder.

12. The system of claim 10, wherein the engagement device allows the landing string to travel longitudinally relative to the riser while the engagement device rotationally secures the rotator assembly and the landing string with respect to the riser.

13. The system of claim 9, wherein the landing string further comprises a profile to engage a feature of a well tree to orient the tubing hanger relative to the landing profile of the wellhead.

14. The system of claim 13, wherein the profile comprises a cam profile, the feature comprises a retractable pin of a blowout preventer, and the cam profile is adapted to guide the pin into an orientation channel of the landing string.

15. The system of claim 9, further comprising:

an orientation measurement device disposed on the landing string to indicate an azimuthal orientation of the tubing hanger; and a telemetry interface disposed on the landing string to communicate an acquired rotational measurement acquired by the measurement device to the sea surface.

16. An apparatus comprising:

an engagement device to be disposed on a landing string, the engagement device comprising a retracted state to allow the apparatus to be run inside a riser and an expanded state to engage the riser to secure the apparatus to the riser;

a rotating device coupled to the engagement device and positioned radially-inward therefrom; and an actuator assembly coupled to the engagement device and the rotating device on the landing string and to be run inside the riser with the engagement device and the rotating device, the actuator assembly being remotely actuatable from a sea surface to rotate the rotating device and the landing string relative to the engagement device to orient a tubing hanger assembly on the landing string with a subsea wellhead.

17. The apparatus of claim 16, wherein the engagement device comprises at least one of a slip, a swellable material, a packer, a resilient element, an elastomer, an expandable spring and a bladder.

18. The apparatus of claim 16, wherein the engagement device is further adapted to allow the landing string to travel in a general longitudinal direction along the riser while the engagement device rotationally secures the landing string with respect to the riser.

19. The apparatus of claim 16, wherein the actuator assembly comprises:

an actuator; and a moveable member rotationally coupled to the actuator to engage a tubing to rotate the tubing.

20. The apparatus of claim 19, wherein the actuator comprises a motor selected from the group consisting of an electrical motor and a hydraulic motor.

* * * * *